US009651894B2

(12) United States Patent
Kim et al.

(10) Patent No.: US 9,651,894 B2
(45) Date of Patent: May 16, 2017

(54) DEVELOPER CARTRIDGE AND ELECTROPHOTOGRAPHIC IMAGE FORMING APPARATUS INCLUDING THE SAME

(71) Applicant: SAMSUNG ELECTRONICS CO., LTD., Suwon-si, Gyeonggi-do (KR)

(72) Inventors: Dong-uk Kim, Hwaseong-si (KR); Jong-in Kim, Suwon-si (KR); Chan-su Park, Suwon-si (KR); Ki-hyun Yoo, Suwon-si (KR); Woong-yong Choi, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/092,314

(22) Filed: Apr. 6, 2016

(65) Prior Publication Data

US 2016/0357126 A1 Dec. 8, 2016

(30) Foreign Application Priority Data

Jun. 5, 2015 (KR) ..... 10-2015-0080031

(51) Int. Cl.
*G03G 15/08* (2006.01)
*G03G 21/16* (2006.01)

(52) U.S. Cl.
CPC ..... *G03G 15/0886* (2013.01); *G03G 15/0863* (2013.01); *G03G 21/1676* (2013.01); *G03G 2215/0692* (2013.01); *G03G 2215/0695* (2013.01)

(58) Field of Classification Search
CPC ..... G03G 15/0886; G03G 15/0863; G03G 21/1676; G03G 2215/0692; G03G 2215/0695; G03G 2221/163
USPC ..... 399/262, 258, 110
See application file for complete search history.

(56) References Cited

U.S. PATENT DOCUMENTS 7,113,731 B2 9/2006 Horikoshi et al.
2006/0104673 A1* 5/2006 Sasae ..... G03G 15/0886 399/262
2010/0008693 A1 1/2010 Hayashi et al.
(Continued)

FOREIGN PATENT DOCUMENTS

EP 2 843 477 A2 3/2015

OTHER PUBLICATIONS

Extended European Search Report dated Nov. 8, 2016 in corresponding European Patent Application No. 16165799.4.

*Primary Examiner* — Sophia S Chen
(74) *Attorney, Agent, or Firm* — Staas & Halsey LLP

(57) ABSTRACT

Provided is a developer cartridge attachable to and detachable from a main body of an image forming apparatus. The developer cartridge includes: a memory unit including a contact portion moved to a first position hidden inside the developer cartridge and a second position protruding outside the developer cartridge; an operating portion configured to move the contact portion to the first position and the second position; an outlet configured to discharge a developer; and a first shutter having an opening position and a closing position for opening and closing the outlet and moved to the closing position and the opening position when the contact portion is moved to the first position and the second position.

20 Claims, 15 Drawing Sheets

(56) References Cited

U.S. PATENT DOCUMENTS

| | | | | |
|---|---|---|---|---|
| 2014/0286679 | A1* | 9/2014 | Nakamura | G03G 15/0886 399/258 |
| 2015/0139688 | A1* | 5/2015 | Leemhuis | G03G 21/1676 399/110 |

* cited by examiner

DEVELOPER CARTRIDGE AND ELECTROPHOTOGRAPHIC IMAGE FORMING APPARATUS INCLUDING THE SAME

CROSS-REFERENCE TO RELATED APPLICATIONS

This application claims the benefit of foreign priority to Korean Patent Application No. 10-2015-0080031, filed on Jun. 5, 2015, in the Korean Intellectual Property Office, the disclosure of which is incorporated herein in its entirety by reference.

BACKGROUND

1. Field

The present disclosure relates to an image forming apparatus forming an image on a recording medium by electrophotography and a developer cartridge attachable to and detachable from the image forming apparatus.

2. Description of the Related Art

An electrophotographic image forming apparatus may supply a toner to an electrostatic latent image formed at a photoconductor, form a visible toner image on the photoconductor, transfer the toner image to a recording medium, and fix the transferred toner image to the recording medium to print an image on the recording medium.

As an assembly of parts for forming the visible toner image, a developing device may be attached to and detached from a main body of the image forming apparatus. The developing device may be replaced when the lifetime thereof ends. A developer cartridge may accommodate a toner therein and supply the toner to the developing device. The developer cartridge may be replaced independently of the developing device when the toner accommodated therein is exhausted.

The developer cartridge may include a toner outlet and a shutter for opening and closing the toner outlet. The developer cartridge may be provided with a memory unit storing various types of information about the developer cartridge. When the developer cartridge is attached to the main body, the memory unit may be electrically connected with the main body to communicate with the main body and transmit the information about the developer cartridge to the main body. The memory unit may include a contact portion that is electrically connected to a connecting portion of the main body.

SUMMARY

Provided are a developer cartridge capable of preventing contamination of a contact portion of a memory unit provided in the developer cartridge for communication with a main body and an image forming apparatus including the developer cartridge.

Provided are a developer cartridge capable of preventing the damage to a contact portion and an image forming apparatus including the developer cartridge.

Provided are a developer cartridge capable of simultaneously operating a contact portion and a shutter for opening/closing a developer outlet and an image forming apparatus including the developer cartridge.

Provided are a developer cartridge capable of preventing the leakage of a developer and an image forming apparatus including the developer cartridge.

Additional aspects will be set forth in part in the description which follows and, in part, will be apparent from the description, or may be learned by practice of the presented embodiments.

According to an aspect of an embodiment, a developer cartridge attachable to and detachable from a main body of an image forming apparatus includes: a memory unit including a contact portion moved to a first position hidden inside the developer cartridge and a second position protruding outside the developer cartridge; an operating portion configured to move the contact portion to the first position and the second position; an outlet configured to discharge a developer; and a first shutter having an opening position and a closing position for opening and closing the outlet and moved to the closing position and the opening position when the contact portion is moved to the first position and the second position.

The developer cartridge may further include a moving member mounted with the contact portion and moved to the first position and the second position.

The operating portion may include a rotary knob. The developer cartridge may further include: a first connecting unit configured to connect the rotary knob and the moving member; and a second connecting unit configured to connect the rotary knob and the moving member and the first shutter.

The operating portion may include a sliding knob. The sliding knob may be connected with the moving member; and the first shutter may be connected with the moving member by a second connecting unit.

The operating portion may include a handle having a receiving position and a gripping position for gripping the developer cartridge. The contact portion and the first shutter may be located respectively at the first position and the closing position when the handle is located at the gripping position; and the contact portion and the first shutter may be switched respectively to the second position and the opening position when the handle is switched from the gripping position to the receiving position.

The developer cartridge may further include a stopper located at a restricting position for restricting an operation of the operating portion when the developer cartridge is detached from the main body. The stopper may be switched to a permitting position for permitting an operation of the operating portion when the developer cartridge is attached to the main body. The stopper may be locked at the restricting position by a locking portion of the first shutter such that the first shutter is not switched to the opening position.

According to an aspect of another embodiment, a developer cartridge attachable to and detachable from a main body of an image forming apparatus includes: a memory unit including a contact portion moved to a first position hidden inside the developer cartridge and a second position protruding outside the developer cartridge; an operating portion configured to move the contact portion to the first position and the second position; and a stopper located at a restricting position for restricting an operation of the operating portion when the developer cartridge is detached from the main body.

The stopper may be switched to a permitting position for permitting an operation of the operating portion when the developer cartridge is attached to the main body.

The developer cartridge may further include: a moving member mounted with the contact portion and moved to the first position and the second position; an outlet configured to discharge a developer; a first shutter having an opening position and a closing position for opening and closing the outlet; and a connecting unit configured to connect the moving member and the first shutter to move the first shutter to the closing position and the opening position when the moving member is moved to the first position and the second position.

The stopper may be locked at the restricting position by a locking portion of the first shutter such that the first shutter is not switched to the opening position.

According to an aspect of another embodiment, an electrophotographic image forming apparatus includes: a main body; and the above developer cartridge attachable to and detachable from the main body.

According to an aspect of another embodiment, an electrophotographic image forming apparatus includes: a main body; and a developer cartridge attachable to and detachable from the main body, wherein the developer cartridge includes: a handle having a receiving position and a gripping position for gripping the developer cartridge; an outlet configured to discharge a developer; a first shutter connected with the handle to be switched to a closing position for closing the outlet and an opening position for opening the outlet when the handle is switched to the gripping position and the receiving position; and a stopper configured to maintain the first shutter at the closing position when the developer cartridge is detached from the main body.

The electrophotographic image forming apparatus may further include a developing device configured to receive a developer from the developer cartridge, wherein the stopper may interfere with the developing device to be switched to a permitting position for permitting the first shutter to be switched to the opening position when the developer cartridge is attached to the main body.

The electrophotographic image forming apparatus may further include a door configured to open and close a portion of the main body, wherein the handle may be switched to the receiving position by a closing operation of the door after the developer cartridge is attached to the main body.

The electrophotographic image forming apparatus may further include a memory unit including a contact portion connected with the handle to be moved to a first position hidden inside the developer cartridge and a second position protruding outside the developer cartridge when the handle is switched to the gripping position and the receiving position.

BRIEF DESCRIPTION OF THE DRAWINGS

These and/or other aspects will become apparent and more readily appreciated from the following description of the embodiments, taken in conjunction with the accompanying drawings in which:

FIGS. 2A and 2B are schematic cross-sectional views illustrating a process of supplying a developer from a developer cartridge to a developing device, wherein FIG. 2A illustrates a state where the supply of a developer from the developer cartridge to the developing device is blocked and FIG. 2B illustrates a state where the supply of a developer from the developer cartridge to the developing device is permitted;

FIGS. 7A and 7B are schematic diagrams illustrating a structure for moving the contact portion to the first position and the second position and moving the first shutter to the closing position and the opening position by operating the knob, according to an embodiment, wherein FIG. 7A illustrates a state where the contact portion is located at the first position and the first shutter is located at the closing position and FIG. 7B illustrates a state where the contact portion is located at the second position and the first shutter is located at the opening position;

FIGS. 9A and 9B are schematic diagrams illustrating a structure for moving the contact portion to the first position and the second position and moving the first shutter to the closing position and the opening position by operating a sliding knob, according to an embodiment, wherein FIG. 9A illustrates a state where the contact portion is located at the first position and the first shutter is located at the closing position and FIG. 9B illustrates a state where the contact portion is located at the second position and the first shutter is located at the opening position;

FIGS. 11A and 11B are schematic diagrams illustrating a structure for moving the contact portion in connection with a handle, according to an embodiment, wherein FIG. 11A is a side view in a state where the handle is located at a gripping position and FIG. 11B is a side view in a state where the handle is located at a receiving position.

DETAILED DESCRIPTION

Figure 1:
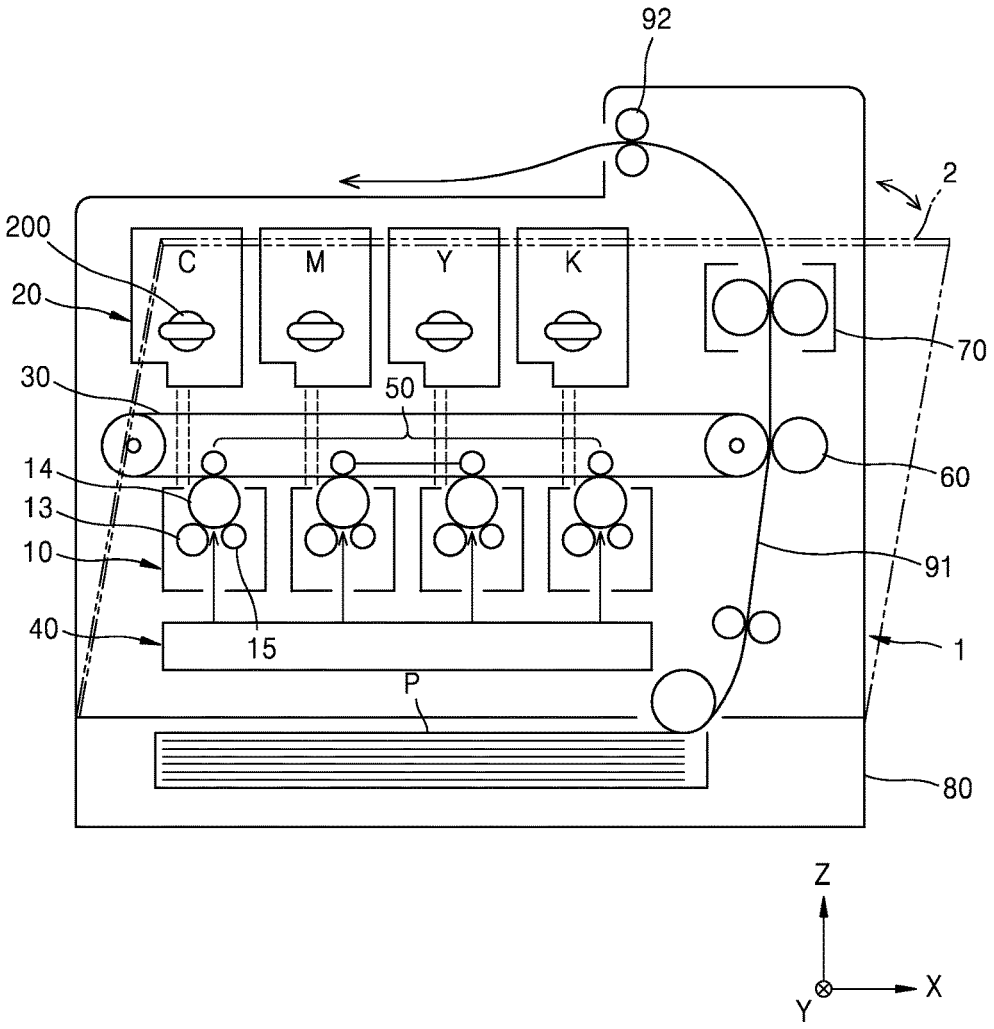
FIG. 1 is a schematic configuration diagram illustrating an electrophotographic image forming apparatus according to an embodiment.

Reference will now be made in detail to the embodiments, examples of which are illustrated in the accompanying drawings, wherein like reference numerals refer to the like elements throughout. The embodiments are described below to explain the present invention by referring to the figures.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects. As used herein, the term "and/or" includes any and all combinations of one or more of the associated listed items. Expressions such as "at least one of," when preceding a list of elements, modify the entire list of elements and do not modify the individual elements of the list.

Hereinafter, embodiments of developer cartridges and image forming apparatuses including the developer cartridges will be described in detail with reference to the accompanying drawings. Also, in the specification and drawings, like reference numerals may denote like elements having substantially the same functions and configurations, and redundant descriptions thereof may be omitted for conciseness.

FIG. 1 is a schematic configuration diagram illustrating an embodiment of an electrophotographic image forming apparatus. The image forming apparatus of the present embodiment may print a color image by electrophotography.

Referring to FIG. 1, the image forming apparatus may include a plurality of developing devices 10 and a plurality of developer cartridges 20 accommodating developers therein. The developer cartridges 20 may be connected respectively with the developing devices 10, and the developers accommodated in the developer cartridges 20 may be supplied respectively to the developing devices 10. The developer cartridges 20 and the developing devices 10 may be replaced separately from each other.

The developing devices 10 may include a plurality of developing devices 10C, 10M, 10Y, and 10K for developing developers of cyan (C), magenta (M), yellow (Y), and black (K) colors. Also, the developer cartridges 20 may include a plurality of developer cartridges 20C, 20M, 20Y, and 20K respectively accommodating developers of cyan (C), magenta (M), yellow (Y), and black (K) colors therein to be supplied to the developing devices 10C, 10M, 10Y, and 10K. However, the scope of the inventive concept is not limited thereto, and other developer cartridges 20 and other developing devices 10 may be further included to accommodate and develop developers of various colors such as light magenta and white, other than the above colors. Hereinafter, an image forming apparatus including a plurality of developing devices 10C, 10M, 10Y, and 10K and a plurality of developer cartridges 20C, 20M, 20Y, and 20K will be described, and unless otherwise specified, reference numerals appended with C, M, Y, and K may respectively denote elements for developing developers of cyan (C), magenta (M), yellow (Y), and black (K) colors.

The developing device 10 may include a photosensitive drum 14 on the surface of which an electrostatic latent image is formed and a developing roller 13 for supplying the developer from the developer cartridge 20 to the electrostatic latent image to develop the electrostatic latent image into a visible toner image. As an example of a photoconductor on the surface of which an electrostatic latent image is formed, the photosensitive drum 14 may include a conductive metal pipe and a photosensitive layer formed at the outer periphery thereof. A charge roller 15 may be an example of a charger for charging the photosensitive drum 14 to have a uniform surface potential. For example, a charge brush or a corona charger may be used instead of the charge roller 15.

Although not illustrated, the developing device 10 may further include, for example, a charge roller cleaner for removing the impurity such as dust or developer attached to the charge roller 15, a cleaning member for removing the developer remaining on the surface of the photosensitive drum 14 after an intermediate transfer process, and a restricting member for restricting the amount of a developer supplied to a developing region where the photosensitive drum 14 and the developing roller 13 face each other.

In the case of using a dual-component developing mechanism, the developer accommodated in the developer cartridge 20 may be a toner. A carrier may be received in the developing device 10. The developing roller 13 may be spaced apart from the photosensitive drum 14 by tens of microns to hundreds of microns. Although not illustrated, the developing roller 13 may be a magnetic roller or may be in the form of a magnetic roller arranged in a developing sleeve. The toner and the carrier may be mixed in the developing device 100, and the toner may be attached to the surface of a magnetic carrier. The magnetic carrier may be attached to the surface of the developing roller 13 and transported to the developing region where the photosensitive drum 14 and the developing roller 13 face each other. Only the toner may be supplied to the photosensitive drum 14 by a developing bias voltage applied between the developing roller 13 and the photosensitive drum 14, and thus the electrostatic latent image formed at the surface of the photosensitive drum 14 may be developed into a visible image.

In the case of using a dual-component developing mechanism, the developer accommodated in the developer cartridge 20 may be a toner and a carrier, and the toner and the carrier may be supplied to the developing device 10. In this case, in order to maintain the uniform ratio between the carrier and the toner in the developing device 10, the excess carrier may be discharged outside the developing device 10 and accommodated in a waste developer container (not illustrated).

In the case of using a mono-component developing mechanism not using the carrier, the developing roller 13 may be rotated in contact with the photosensitive drum 14 or may be rotated while being spaced apart from the photosensitive drum 14 by tens of microns to hundreds of microns. The toner may be accommodated in the developer cartridge 20, and the developing device 10 may further include a transport member for agitating the toner flowing in from the developer cartridge 20 and transporting the agitated toner to the developing roller 13.

Although not illustrated, the developing device 10 may further include a cleaning unit for removing the waste toner remaining on the photosensitive drum 14 after a transfer process.

Although examples of a developing mechanism of the image forming apparatus according to an embodiment have been described above, the developing mechanism is not limited thereto and various modifications and changes may be made in the developing mechanism.

An exposer 40 may irradiate a light, which is modulated corresponding to image information, to the photosensitive drum 14 to form an electrostatic latent image on the photosensitive drum 14. The exposer 40 may include, for example, a laser scanning unit (LSU) using a laser diode as a light source or a light emitting diode (LED) exposer using an LED as a light source.

An intermediate transfer belt 30 may temporarily receive the toner image developed on the photosensitive drums 14 of the developing devices 10C, 10M, 10Y, and 10K. A plurality of intermediate transfer rollers 50 may be arranged at positions facing the photosensitive drums 14 of the developing devices 10C, 10M, 10Y, and 10K, with the intermediate transfer belt 30 interposed therebetween. An intermediate transfer bias voltage for intermediately transferring the image developed on the photosensitive drums 14 to the intermediate transfer belt 30 may be applied to the intermediate transfer rollers 50. A corona transferer or a pin scorotron transferer may be used instead of the intermediate transfer roller 50.

A transfer roller 60 may be located to face the intermediate transfer belt 30. A transfer bias voltage for transferring the toner image transferred to the intermediate transfer belt 30 onto a recording medium P may be applied to the transfer roller 60

Although an embodiment of intermediately transmitting the image developed on the photosensitive drums 14 to the intermediate transfer belt 30 and then transferring the toner image onto the recording medium P passing between the intermediate transfer belt 30 and the transfer roller 60 has been described above, the inventive concept is not limited thereto. For example, according to another embodiment, the developed image may be directly transferred onto the recording medium P passing directly between the intermediate transfer belt 30 and the photosensitive drums 14. In this case, the transfer roller 60 may not be used.

A fixing device 70 may apply heat and/or pressure to the toner image, which is transferred onto the recording medium P, to fix the toner image to the recording medium P. The type of the fixing device 70 is not limited to the example illustrated in FIG. 1.

By the above configuration, the exposer 40 may form an electrostatic latent image on the photosensitive drums 14 by irradiating the lights, which are modulated corresponding to the image information of the respective colors, to the photosensitive drums 14 of the developing devices 10C, 10M, 10Y, and 10K. The electrostatic latent image on the photosensitive drums 14 of the developing devices 10C, 10M, 10Y, and 10K may be developed into a visible toner image by the C, M, Y, and K developers supplied from the developer cartridges 20C, 20M, 20Y, and 20K to the developing devices 10C, 10M, 10Y, and 10K. The developed toner images may be sequentially intermediately-transferred to the intermediate transfer belt 30. The recording medium P loaded on a paper feeding unit 80 may be transferred along a paper feeding path 91 and then transferred between the transfer roller 60 and the intermediate transfer belt 30. The toner image intermediately-transferred onto the intermediate transfer belt 30 may be transferred onto the recording medium P by the transfer bias voltage applied to the transfer roller 60. When the recording medium P passes out through the fixing device 70, the toner image may be fixed to the recording medium P by heat and pressure. Upon completion of the fixing, the recording medium P may be discharged by a discharge roller 92.

Referring to FIG. 1, the paper feeding path 91 may be projected on an XZ plane, and the developing device 10 and the developer cartridge 20 may be attached/detached to/from a main body 1 of the image forming apparatus by being slid in a Y direction perpendicular to the XZ plane. That is, for example, the recording medium P may be transported in the lengthwise direction thereof along the paper feeding path 91, and the developing device 10 and the developer cartridge 20 may be attached/detached to/from the main body 1 of the image forming apparatus in the widthwise direction of the recording medium P. The main body 1 may be provided with a door 2 for opening a portion of the main body 1 for attachment/detachment of the developer cartridge 20 and the developing device 10. For example, the door 2 may be configured to open/close one side of the main body 1 in the attachment/detachment direction (Y) of the developer cartridge 20 and the developing device 10.

Figure 2A:
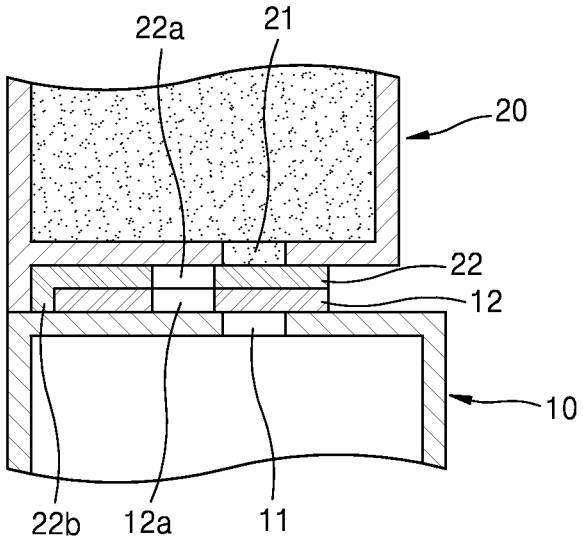
Figure 2B:
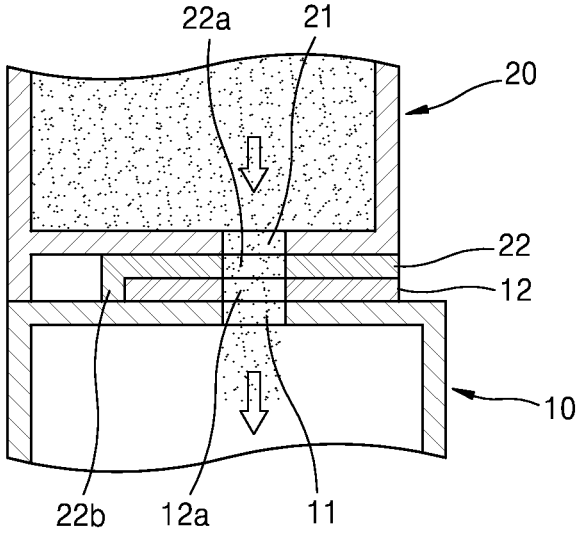

FIGS. 2A and 2B are schematic cross-sectional views illustrating a process of supplying a developer from the developer cartridge 20 to the developing device 10. FIG. 2A illustrates a state where the supply of a developer from the developer cartridge 20 to the developing device 10 is blocked, and FIG. 2B illustrates a state where the supply of a developer from the developer cartridge 20 to the developing device 10 is permitted.

Referring to FIGS. 2A and 2B, when the developer cartridge 20 is attached to the main body 1, the developer cartridge 20 may be located over the developing device 10. The developer cartridge 20 may include an outlet 21 for discharging a developer. The developer cartridge 20 may be provided with a first shutter 22 for opening/closing the outlet 21. The first shutter 22 may be provided with a first opening 22*a*. The first shutter 22 may be moved to a closing position (FIG. 2A) for closing the outlet 21 and an opening position (FIG. 2B) for permitting the discharge of a developer through the outlet 21. For example, at the closing position, the first opening 22*a* and the outlet 21 may be misaligned with each other and thus the outlet 21 may be closed by the first shutter 22. At the opening position, the outlet 21 and the first opening 22*a* may be aligned with each other and thus the developer may be discharged through the outlet 21 and the first opening 22*a*.

The developing device 10 may be provided with an inlet 11 through which the developer flows in. For example, when the developing device 10 and the developer cartridge 20 are attached to the main body 1, the outlet 21 and the inlet 11 may be aligned with each other in a vertical direction. Thus, when the first shutter 22 is located at the opening position, the developer may be supplied from the developer cartridge 20 to the developer device 10 through the outlet 21, the first opening 22*a*, and the inlet 11.

The developing device 10 may be provided with a second shutter 12 for opening/closing the inlet 11. The second shutter 12 may be provided with a second opening 12*a*. When the second shutter 12 is located at the closing position (FIG. 2A), the second opening 12*a* and the inlet 11 may be misaligned with each other and thus the inlet 11 may be closed by the second shutter 12. When the second shutter 12 is located at the opening position (FIG. 2B), the inlet 11 and the second opening 12*a* may be aligned with each other and thus the developer may flow into the developing device 10 through the second opening 12*a* and the inlet 11.

The second shutter 12 may be moved to the opening position by the first shutter 22 when the first shutter 22 is moved from the closing position to the opening position. For example, the first shutter 22 may be provided with an operating portion 22*b* for pushing and moving the second shutter 12 to the opening position when the first shutter 22 is moved from the closing position to the opening position. By this configuration, when the first shutter 22 is moved from the closing position to the opening position, the second shutter 12 may be pushed and moved by the operating portion 22*b* from the closing position to the opening position.

Although not illustrated, a return spring may be further provided to supply the second shutter 12 with an elastic force in the direction of returning from the opening position to the closing position.

When the first shutter 22 is moved to the opening position in a state where the developer cartridge 20 is not attached to the main body 1, the toner in the developer cartridge 20 may leak through the outlet 21 and the first opening 22*a*. Therefore, a device for preventing an undesired external leakage of the developer may be required.

Figure 3A:
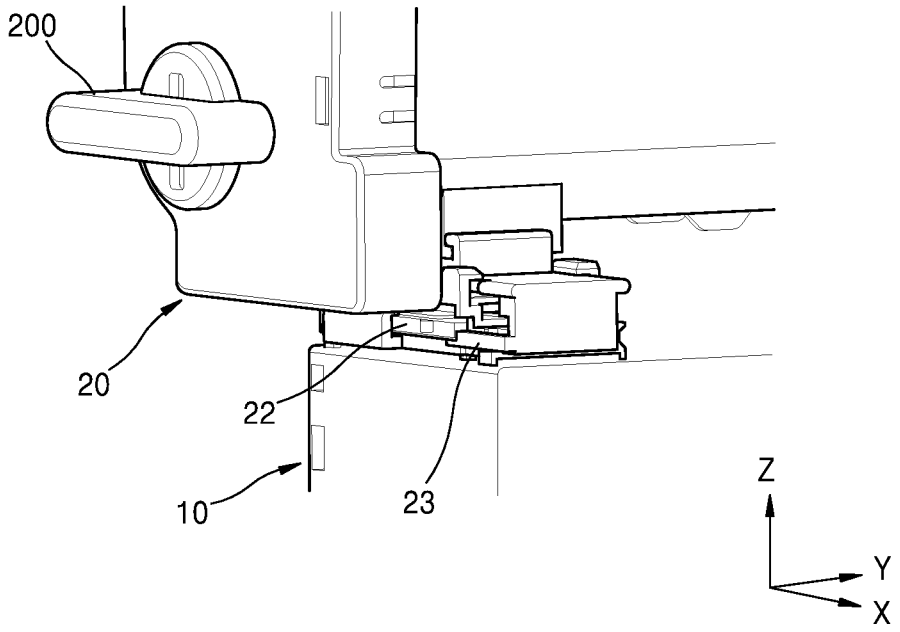
FIG. 3A is a partial perspective view of an example of a structure for preventing leakage of a developer.
Figure 3B:
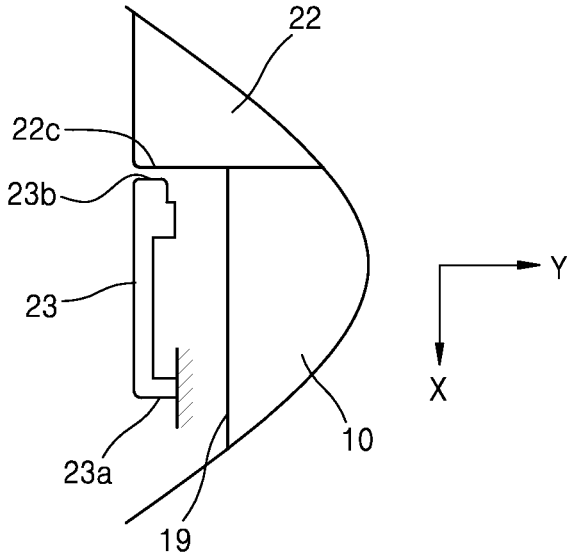
FIG. 3B is a schematic diagram illustrating a state where a stopper is located at a restricting position.
Figure 3C:
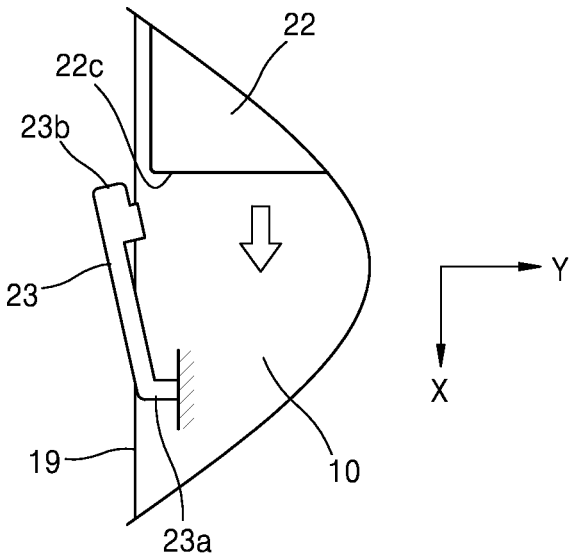
FIG. 3C is a schematic diagram illustrating a state where the stopper is located at a permitting position.

FIG. 3A is a partial perspective view illustrating an example of a structure for preventing the leakage of a developer. FIG. 3B is a schematic diagram illustrating a state where a stopper 23 is located at a restricting position, and FIG. 3C is a schematic diagram illustrating a state where the stopper 23 is located at a permitting position. In FIGS. 3B and 3C, an operation of the stopper 23 is schematically illustrated, and other elements irrelevant to the operation of the stopper 23 are omitted.

Referring to FIGS. 3A, 3B, and 3C, the developer cartridge 20 may be provided with the stopper 23 for restricting the movement of the first shutter 22 to the opening position. The stopper 23 may be located at the restricting position (FIG. 3B) for restricting the movement of the first shutter 22 to the opening position in a state where the developer cartridge 20 is detached from the main body 1, and may be located at the permitting position (FIG. 3C) for permitting the movement of the first shutter 22 to the opening position when the developer cartridge 20 is attached to the main body 1.

For example, the stopper 23 may be in the form of a cantilever the end portion 23*a* of which is supported by the developer cartridge 20. When located at the restricting position, the other end portion 23*b* of the stopper 23 may be locked by a locking portion 22*c* of the first shutter 22. Thus, for example, the first shutter 22 may not be moved in an X direction by being locked by the stopper 23. The stopper 23 may be moved to the permitting position by an operation of attaching the developer cartridge 20 to the main body 1. For example, the stopper 23 may be switched to the permitting position by interfering with the developing device 10 or the main body 1. In the present embodiment, the stopper 23 may be switched to the permitting position by interfering with a sidewall 19 of the developing device 10. That is, for example, when the developer cartridge 20 is moved in a Y direction and attached to the main body 1, the stopper 23 may be bent by interfering with the sidewall 19 of the developing device 10 and thus the other end portion 23*b* may be switched to the permitting position deviating from the locking portion 22*c*. Thus, the first shutter 22 may be moved in an arrow direction of FIG. 3C.

When the developer cartridge 20 is detached from the main body 1, the stopper 23 may be returned to the restricting position by an elastic restoring force. By this configuration, the leakage of the developer may be prevented in the state where the developer cartridge 20 is detached from the main body 1.

The structure of the stopper 23 is not limited to the structure illustrated in FIGS. 3A, 3B, and 3C. For example, the stopper 23 may be supported by the developer cartridge 20 to be slid or pivoted to the restricting position and the permitting position, or may be elastically-biased by an elastic member (not illustrated) in the direction of returning to the restricting position.

Figure 4:
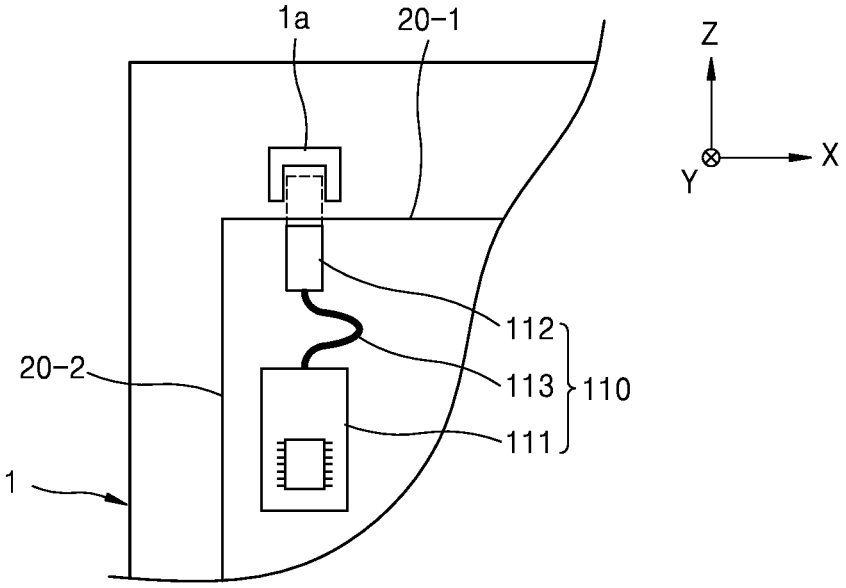
FIG. 4 is a front view of the image forming apparatus according to an embodiment.

FIG. 4 is a front view illustrating an embodiment of the image forming apparatus. Referring to FIG. 4, the developer cartridge 20 may be provided with a memory unit 110. When the developer cartridge 20 is attached to the main body 1, the memory unit 110 may be electrically connected with the main body 1 to transmit information about the developer cartridge 20 to the main body 1. The main body 1 may determine whether the developer cartridge 20 is attached to the main body 1, according to whether the main body 1 is electrically connected with the memory unit 110, for example, according to whether the main body 1 may communicate with the memory unit 110.

The memory unit 110 may include a circuit portion 111 for monitoring or managing the state of the developer cartridge 20 and a contact portion 112 for connecting with the main body 1. For example, the circuit portion 111 may be provided with a customer replaceable unit monitor (CRUM) portion including a central processing unit (CPU) for performing at least one of authentication and/or encryption data communication with the main body 1 by using its own operating system (O/S). The circuit portion 111 may further include a memory. The memory may store various types of information about the developer cartridge 20. For example, the memory may store information about the manufacturer, information about the manufacturing date and time, unique information such as the model name and the serial number, various programs, electronic signature information, and information about the use state (e.g., the number of copies printed up to now, the number of residual copies printable from now, and the residual developer amount). Also, for example, the memory may store information about the setup menu and the lifetime of the developer cartridge 20. In addition, for example, the circuit portion 111 may include one or more functional blocks capable of performing various functions for encryption, authentication, and communication with the main body 1. The circuit portion 111 may be implemented in the form of a chip including a CPU, in the form of a chip including a CPU and a memory, or in the form of a printed circuit board (PCB) mounted with a chip and circuit elements for implementing various functional blocks.

The contact portion 112 may be formed integrally with a PCB of the circuit portion 111, or may be connected with the circuit portion 111 by a signal line 113 as illustrated in FIG. 4. The contact portion 112 may be, for example, a modular jack. The main body 1 may be provided with a connecting portion 1*a* connected with the contact portion 112. The connecting portion 1*a* may be of a modular connector type in which the contact portion 112 of a modular jack type is inserted. Also, the contact portion 112 may be of a conductive pattern type. The contact portion 112 of a conductive pattern type may be formed at a circuit board (not illustrated) or may be formed integrally with a PCB of the circuit portion 111. The memory unit 110 may be of a package type in which the circuit portion 111 is embedded and the contact portion 112 is exposed outside, and the contact portion 112 may be exposed outside the package as a conductive pattern type. In this case, the connecting portion 1*a* may include a pin-type terminal that may be electrically connected to the contact portion 112 of a conductive pattern type. Also, the contact portion 112 may be in the form of a pin-type terminal, and the connecting portion 1*a* may be in the form of a conductive pattern to which the pin-type terminal is connected. In addition, the contact portion 112 and the connecting portion 1*a* may have various forms in which they may be electrically connected to each other.

When the contact portion 112 protrudes outside the developer cartridge 20 as illustrated by a broken line in FIG. 4, the contact portion 112 may be contaminated or damaged in the process of handling the developer cartridge 20. Also, the contact portion 112 may be damaged by a collision with the main body 1 in the process of attaching the developer cartridge 20 to the main body 1. The damage or contamination of the contact portion 112 may cause a poor contact between the contact portion 112 and the connecting portion 1*a*. In order to solve this problem, the memory unit 110 of the present embodiment may include the contact portion 112 that may be moved to a first position hidden inside the developer cartridge 20 (i.e., a position illustrated by a solid line in FIG. 4) and a second position protruded from the developer cartridge 20 (i.e., a position illustrated by the broken line in FIG. 4). When the developer cartridge 20 is attached to the main body 1, the contact portion 112 may be moved to the second position where it is electrically connected to the connecting portion 1*a* provided at the main body 1; and before the developer cartridge 20 is detached from the main body 1, the contact portion 112 may be moved to the second position where it is electrically disconnected from the connecting portion 1*a*. The protruding direction of the contact portion 112 at the second position is not particularly limited. For example, the contact portion 112 may protrude in various directions such as outside from a top portion 20-1, a bottom portion, a side portion 20-2, a front portion, and a rear portion of the developer cartridge 20. Hereinafter, a structure in which the contact portion 112 protrudes outside from the top portion 20-1 of the developer cartridge 20 by moving in the Z direction perpendicular to the lengthwise direction (X) of the recording medium P and the attachment direction (Y) of the developer cartridge 20 will be described as an example.

The contact portion 112 may be moved by a user's manual operation to the first position and the second position. The developer cartridge 20 may further include an operating portion for moving the contact portion 112. Referring to FIG. 1, the developer cartridge 20 may be provided with a knob 200 as an example of the operating portion. The user may move the contact portion 112 to the first position and the second position by operating the knob 200. Also, the user may switch the first shutter 22 to the closing position and the opening position by operating the knob 200. Accordingly, by operating the knob 200, the user may move the contact portion 112 to the first position and the second position and simultaneously switch the first shutter 22 to the closing position and the opening position.

Figure 5:
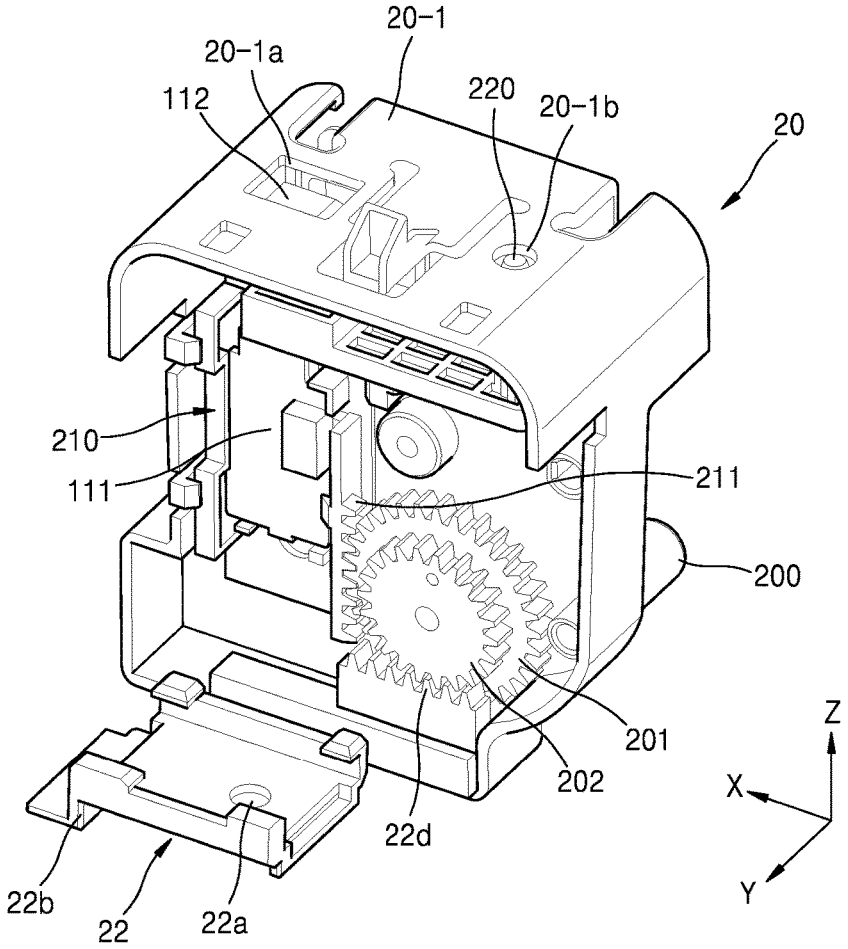
FIG. 5 is a partial perspective view of a developer cartridge including a structure for moving a contact portion to a first position and a second position and moving a first shutter to a closing position and an opening position by operating a knob, according to an embodiment.
Figure 6A:
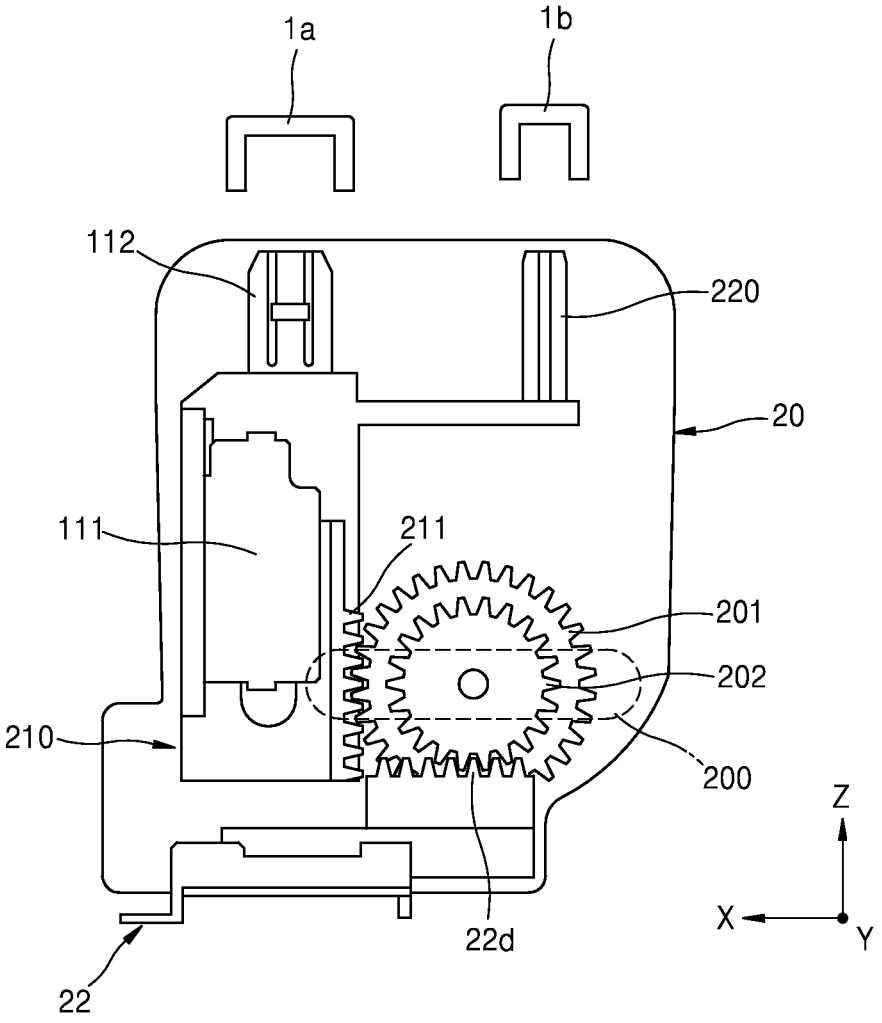
FIG. 6A is a schematic diagram illustrating a state where the contact portion is located at the first position and the first shutter is located at the closing position, in the developer cartridge illustrated in FIG. 5, according to an embodiment.

FIG. 5 is a partial perspective view illustrating the developer cartridge 20 including an embodiment of a structure for moving the contact portion 112 to the first position and the second position and moving the first shutter 22 to the closing position and the opening position by operating the knob 200. FIG. 6A is a schematic diagram illustrating a state where the contact portion 112 is located at the first position and the first shutter 22 is located at the closing position, and FIG. 6B is a schematic diagram illustrating a state where the contact portion 112 is located at the second position and the first shutter 22 is located at the opening position.

Referring to FIG. 5, the developer cartridge 20 may be provided with a moving member 210 installed to be slidable in the Z direction. The contact portion 112 may be fixed to the moving member 210 and may be connected with the circuit portion 111 by the signal line 113 (see FIG. 4). The knob 200 of the present embodiment may be a rotary knob. The knob 200 may be directly or indirectly connected with the moving member 210. For example, the knob 200 may be connected with the moving member 210 by a first connecting unit. A rotating movement of the knob 200 may be converted by the first connecting unit into a linear sliding movement of the moving member 210. For example, the first connecting unit may be implemented by a first pinion 201 and a first rack gear 211. The first rack gear 211 may be provided for the moving member 210. The first pinion 201 may connect with the knob 200 to rotate together with the knob 200, and may engage with the first rack gear 211.

Figure 6B:
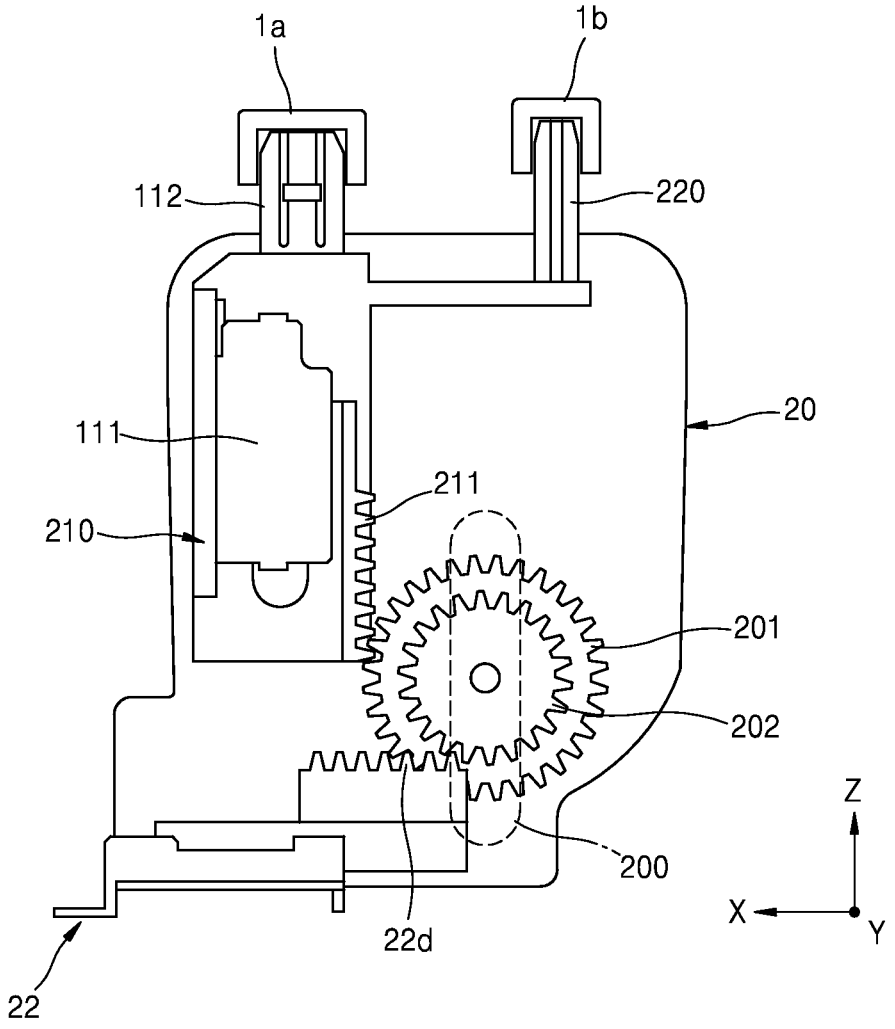
FIG. 6B is a schematic diagram illustrating a state where the contact portion is located at the second position and the first shutter is located at the opening position, in the developer cartridge illustrated in FIG. 5, according to an embodiment.

By this configuration, when the knob 200 is rotated, a rotating operation of the knob 200 may be converted into a linear movement of the moving member 210 by the first pinion 201 and the first rack gear 211 and thus the contact portion 112 may be moved to the first position hidden inside the developer cartridge 20 illustrated in FIG. 6A and the second position protruded from the developer cartridge 20 as illustrated in FIG. 6B.

The top surface of the developer cartridge 20 may be provided with a first gateway 20-1*a* through which the contact portion 112 enters and exits. When the contact portion 112 is located at the first position as illustrated in FIG. 6A, the contact portion 112 may be received in the developer cartridge 20 and may not be exposed through the first gateway 20-1*a*. In this state, as illustrated in FIG. 1, the door 2 may be opened and the developer cartridge 20 may be attached to the main body 1. Thereafter, the knob 200 may be rotated to move the contact portion 112 to the second position as illustrated in FIG. 6B. Then, the contact portion 112 may be protruded from the developer cartridge 20 through the first gateway 20-1*a*, and the contact portion 112 may be connected to the connecting portion 1*a* of the main body 1 and thus the memory unit 110 and the main body 1 may be connected to each other as illustrated by the broken line in FIG. 4.

The first shutter 22 may be moved to the closing position and the opening position by the operation of the knob 200. That is, for example, since the contact portion 112 is moved to the first position and the second position, the first shutter 22 may be switched to the closing position and the opening position. The first shutter 22 may be connected with the knob 200 and the moving member 210 by a second connecting unit. For example, the second connecting unit may include a second rack gear 22*d* provided for the first shutter 22. When the stroke of the moving member 210 is equal to the stroke of the first shutter 22, the second rack gear 22*d* may engage with the first pinion 201. When the stroke of the moving member 210 is different from the stroke of the first shutter 22, the second rack gear 22*d* may engage with a second pinion 202 having a different number of teeth than the first pinion 201 as illustrated in FIG. 5. For example, the second pinion 202 may be installed coaxially with the first pinion 201 and connected with the knob 200. That is, for example, the first pinion 201 and the second pinion 202 may be in the form of a two-stage gear. Although not illustrated, the second pinion 202 may engage with the first pinion 201 and the second rack gear 22*d*. In this case, one or more reduction gears may be interposed between the first pinion 201 and the second pinion 202. In some cases, an idle gear for determining the movement direction of the first shutter 22 may be interposed between the first pinion 201 and the second pinion 202.

By this configuration, when the knob 200 is rotated, a rotating operation of the knob 200 may be converted into a linear movement of the first shutter 22 by the second pinion 202 and the second rack gear 22*d* and thus the first shutter 22 may be moved to the closing position illustrated in FIGS. 2A and 6A and the opening position illustrated in FIGS. 2B and 6B.

The movement direction of the moving member 210 and the first shutter 22 may be determined according to the structure of the first connecting unit and the second connecting unit. For example, a first bevel gear (not illustrated) may be used as the first and second pinions 201 and 202, and a second bevel gear (not illustrated) engaging with the first and second pinions 201 and 202 and a spur gear (not illustrated) coaxial with the second bevel gear (not illustrated) may be arranged between the first and second rack gears 211 and 22*d* and the first and second pinions 201 and 202, so that the spur gear (not illustrated) and the first and second rack gears 211 and 22*d* may engage with each other. By this structure of the first connecting unit, the moving member 210 may be moved in the lengthwise direction (Y) or the widthwise direction (X) of the developer cartridge 20, and the contact portion 112 may be located at the second position by protruding from the front/rear portion or the side portion 20-2 of the developer cartridge 20. Also, by this structure of the second connecting unit, the first shutter 22 may be switched to the closing position and the opening position by moving in a direction different from the direction illustrated in FIGS. 6A and 6B.

By this configuration, in the developer cartridge 20, the first shutter 22 may be moved to the closing position and the opening position simultaneously when the contact portion 112 is moved to the first position and the second position.

In the embodiment illustrated in FIGS. 5, 6A, and 6B, the circuit portion 111 may be attached to the moving member 210 and moved together with the contact portion 112. By this configuration, since the relative position between the contact portion 112 and the circuit portion 111 does not change during the movement of the contact portion 112 to the first position and the second position, the risk of a disconnection between the signal line 113 and the contact portion 112 and the circuit portion 111 may be greatly reduced. However, the scope of the inventive concept is not limited thereto. For example, the contact portion 112 may be formed integrally with the circuit portion 111, and thus the signal line 113 may be omitted. Also, the circuit portion 111 may be fixed to the developer cartridge 20, and only the contact portion 112 may be installed at the moving member 210.

Referring to FIGS. 3B and 3C, the position switching of the first shutter 22 may be restricted by the stopper 23. The stopper 23 may also restrict the movement of the contact portion 112 to the first position and the second position. That is, for example, when the developer cartridge 20 is detached from the main body 1, the stopper 23 may restrict the movement of the contact portion 112 to the second position to maintain the same at the first position.

For example, when the contact portion 112 is located at the second position in a state where the developer cartridge 20 is detached from the main body 1, the contact portion 112 may be contaminated or damaged by an external impact in the process of handling the developer cartridge 20. Also, when the developer cartridge 20 is attached to the main body 1 in a state where the contact portion 112 is located at the second position, the contact portion 112 and/or the connecting portion 1*a* may be damaged by a collision between the contact portion 112 and the connecting portion 1*a*.

According to the present embodiment, the stopper 23 may be located at the restricting position for restricting the switching of the first shutter 22 to the opening position in a state where the developer cartridge 20 is detached from the main body 1. Since the first shutter 22 is connected to the knob 200 and the moving member 210 by the second connecting unit, the knob 200 may not be rotated in a state where the position switching of the first shutter 22 is restricted. Thus, the contact portion 112 also may not be switched to the second position and may be maintained at the first position. That is, for example, the stopper 23 may be located at the restricting position for restricting an operation of the operating portion when the developer cartridge 20 is detached from the main body 1, and may be located at the permitting position for permitting an operation of the operating portion when the developer cartridge 20 is attached to the main body 1. In this manner, when the developer cartridge 20 is detached from the main body 1, the stopper 23 may restrict the movement of the contact portion 112 to the second position to maintain the contact portion 112 at the first position.

The developer cartridge 20 may be attached to the main body 1 in a state where the contact portion 112 is located at the first position (see FIG. 6A). As described above with reference to FIGS. 3B and 3C, by an operation of attaching the developer cartridge 20, the stopper 23 may be switched from the restricting position to the permitting position for permitting the switching of the first shutter 22 to the opening position. After the developer cartridge 20 is attached to the main body 1, the knob 200 may be rotated to move the contact portion 112 to the second position (see FIG. 6B) to connect the contact portion 112 to the connecting portion 1*a* of the main body 1. In this case, the first shutter 22 may be switched to the opening position by the rotation of the knob 200, and the second shutter 12 may also be switched to the opening position together with the first shutter 22, so that the developer may be supplied from the developer cartridge 20 to the developing device 10.

When the developer cartridge 20 is to be detached from the main body 1, the knob 200 may be rotated to return the contact portion 112 to the first position to release the connection thereof with the connecting portion 1*a* before the detachment of the developer cartridge 20 from the main body 1. In this case, the first shutter 22 may be returned to the closing position, and thus the leakage of the developer through the outlet 21 may be prevented in the detachment process. When the first shutter 22 is returned to the closing position, the second shutter 12 may also be returned to the closing position by a return spring (not illustrated). Alternatively, the second shutter 12 may be maintained at the opening position.

The connecting portion 1*a* or the contact portion 112 may be damaged when the developer cartridge 20 is detached from the main body 1 in a state where the contact portion 112 is located at the second position. The developer cartridge 20 of the present embodiment may further include a protecting member 220 for preventing the damage to the connecting portion 1*a* or the contact portion 112.

Referring to FIGS. 5, 6A, and 6B, the protecting member 220 may be moved together with the contact portion 112 by the operation of the knob 200. The protecting member 220 may have a retracting position hidden inside the developer cartridge 20 and a protruding position protruded from the developer cartridge 20. As an example, the protecting member 220 may be formed integrally with the moving member 210. The top portion 20-1 of the developer cartridge 20 may be provided with a second gateway 20-1*b* through which the protecting member 220 enters and exits. The main body 1 may be provided with an insertion portion 1*b* into which the protecting member 220 is inserted. At the protruding position, the protecting member 220 may be inserted into the insertion portion 1*b*.

By this configuration, the protecting member 220 may be located at the retracting position received in the developer cartridge 20 in a state where the contact portion 112 is located at the first position as illustrated in FIG. 6A. When the contact portion 112 is located at the second position by the rotation of the knob 120 as illustrated in FIG. 6B, the protecting member 220 may be protruded from the top portion 20-1 of the developer cartridge 20 through the second gateway 20-1*b* and located at the protruding position inserted into the insertion portion 1*b*.

The protecting member 220 may protrude more than the contact portion 112 in the direction of sliding to the protruding position. Also, although not illustrated, the insertion portion 1*b* may be located nearer to the top portion 20-1 of the developer cartridge 20 than the connecting portion 1*a*. The contact portion 112 may be damaged by collision with the connecting portion 1*a* when the contact portion 112 is inserted into the connecting portion 1*a* in a state where the contact portion 112 and the connecting portion 1*a* are not completely aligned with each other, that is, in a state where the developer cartridge 20 is not completely inserted. According to the present embodiment, the contact portion 112 and the connecting portion 1*a* may be aligned with each other since the protecting member 220 is first inserted into the insertion portion 1*b* before the contact portion 112 is inserted into the connecting portion 1*a*. Accordingly, the risk of damage to the contact portion 112 may be reduced in the process of inserting the contact portion 112 into the connecting portion 1*a*.

When the developer cartridge 20 is to be detached from the main body 1 in the state illustrated in FIG. 6B, since the contact portion 112 is in the state of being inserted in the connecting portion 1*a*, a force may be applied to the contact portion 112. According to the present embodiment, since the protecting member 220 is also in the state of being inserted in the insertion portion 1*b*, the force applied to the contact portion 112 may be distributed by the protecting member 220. Accordingly, the risk of damage to the contact portion 112 may be reduced.

Figure 7A:
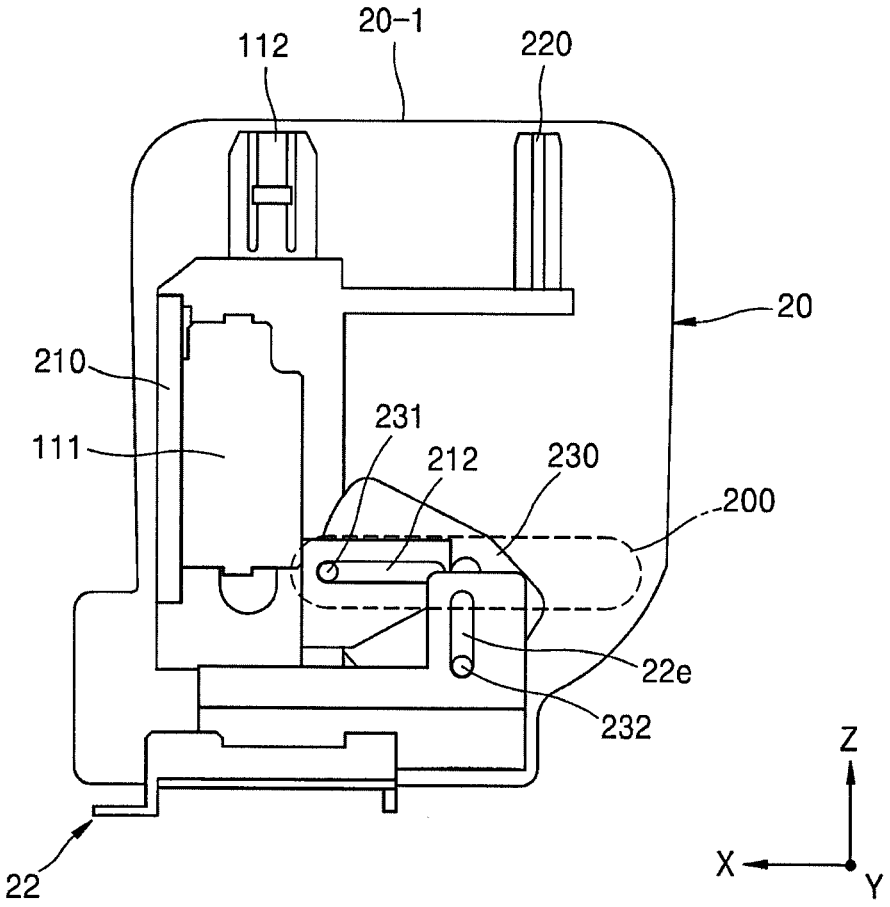
Figure 7B:
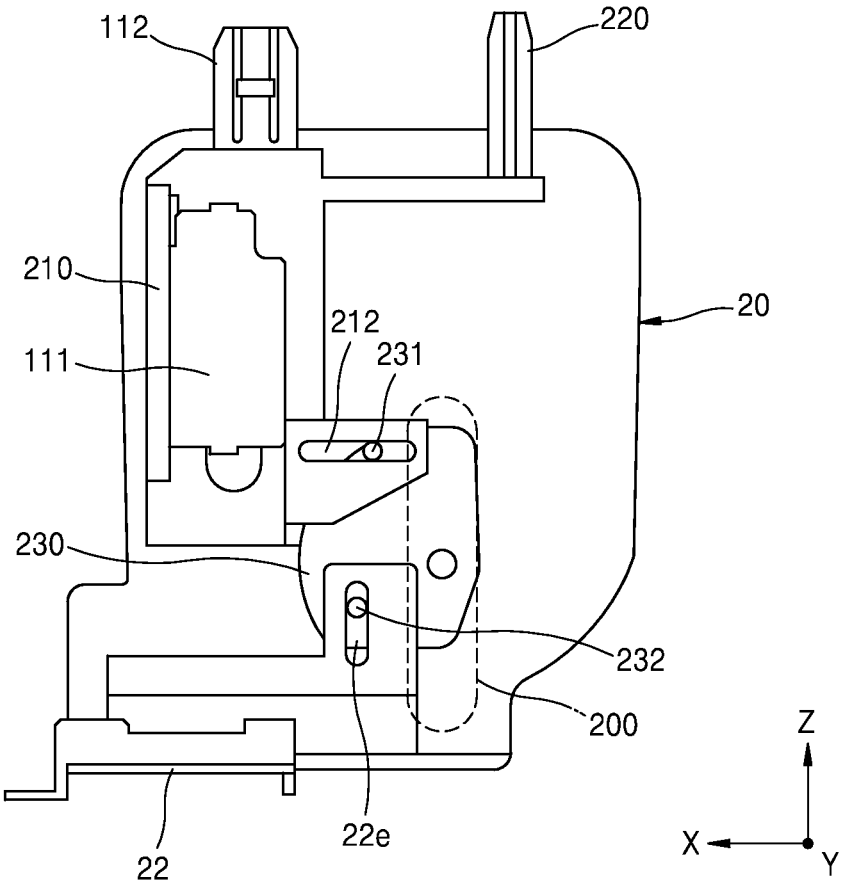

FIGS. 7A and 7B are schematic diagrams illustrating an embodiment of a structure for moving the contact portion 112 to the first position and the second position and moving the first shutter 22 to the closing position and the opening position by operating the knob 200. FIG. 7A illustrates a state where the contact portion 112 is located at the first position and the first shutter 22 is located at the closing position, and FIG. 7B illustrates a state where the contact portion 112 is located at the second position and the first shutter 22 is located at the opening position.

Referring to FIGS. 7A and 7B, the first connecting unit may be implemented by a rotating member 230 including a first guide pin 231 and a first guide slot 212 provided for the moving member 210. The second connecting unit may be implemented by a second guide pin 232 provided for the rotating member 230 and a second guide slot 22*e* provided for the first shutter 22. The rotating member 230 may be connected with the knob 200 to rotate together with the knob 200. The first and second guide pins 231 and 232 may be inserted respectively into the first and second guide slots 212 and 22*e*. The first and second guide slots 212 and 22*e* may have one end portion and the other end portion that are spaced apart from each other at least in the direction perpendicular to the movement direction of the first shutter 22 and the moving member 210. Although FIGS. 7A and 7B illustrate that the first and second guide slots 212 and 22*e* have a linear shape, the shape of the first and second guide slots 212 and 22*e* is not limited thereto and the first and second guide slots 212 and 22*e* may also have a curved shape. By the first and second guide pins 231 and 232 and the first and second guide slots 212 and 22*e*, the rotating movement of the knob 200 may be converted into the linear movement of the first shutter 22 and the moving member 210. Although not illustrated, the first and second guide slots 212 and 22*e* may be provided respectively for the moving member 210 and the first shutter 22, and the first and second guide pins 231 and 232 may be provided for the rotating member 230.

By this configuration, the rotating member 230 may be rotated simultaneously when the knob 200 is rotated. The first and second guide pins 231 and 232 may push the first and second guide slots 212 and 22*e*, and thus the moving member 210 and the first shutter 22 may be converted respectively to the first/second position and the closing/opening position. Although the present embodiment illustrates the structure for connecting the rotating member 230 and the knob 200 directly to each other, the rotating member 230 and the knob 200 may also be connected to each other by a power connection member such as a gear.

Although the above embodiments illustrate the structure for using the rotary knob 200 to move the contact portion 112 to the first position and the second position and move the first shutter 22 to the closing position and the opening position, the scope of the inventive concept is not limited thereto.

Figure 8:
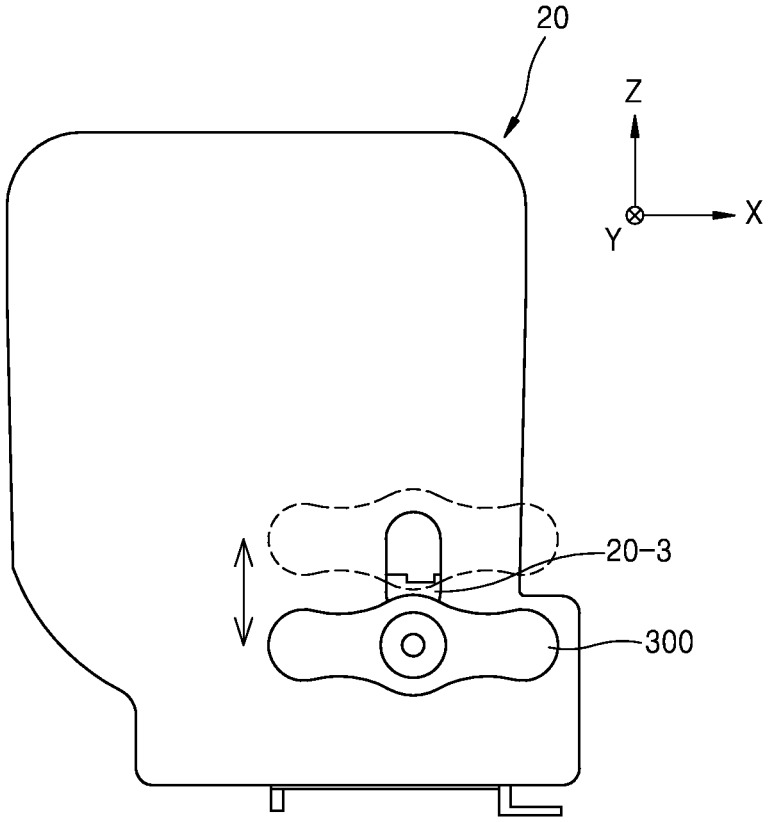
FIG. 8 is a schematic front view of the developer cartridge, according to an embodiment.
Figure 9A:
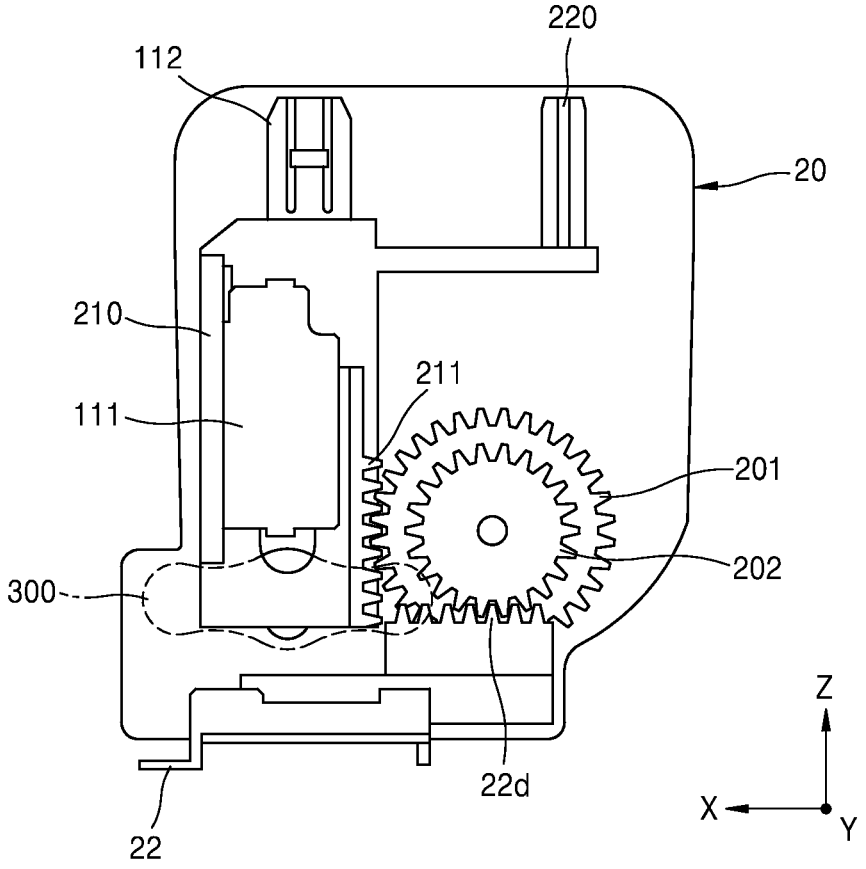
Figure 9B:
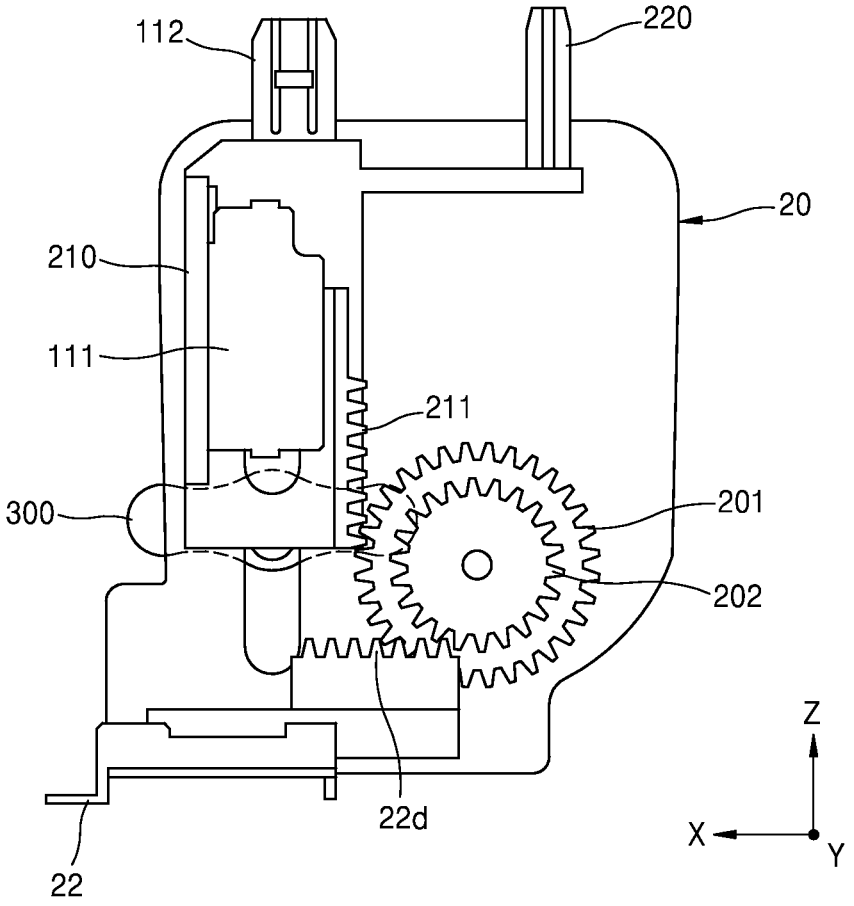

FIG. 8 is a schematic front view illustrating an embodiment of the developer cartridge 20. In FIG. 8, a sliding knob 300 is illustrated. The knob 300 may be slid along a sliding slot 20-3 provided at the developer cartridge 20. For example, the sliding slot 20-3 may extend in the movement direction of the contact portion 112, that is, in the Z direction. Also, the sliding knob 300 may be used to move the contact portion 112 to the first position and the second position and move the first shutter 22 to the closing position and the opening position. FIGS. 9A and 9B are schematic diagrams illustrating an embodiment of a structure for moving the contact portion 112 to the first position and the second position and moving the first shutter 22 to the closing position and the opening position by operating the sliding knob 300. FIG. 9A illustrates a state where the contact portion 112 is located at the first position and the first shutter 22 is located at the closing position, and FIG. 9B illustrates a state where the contact portion 112 is located at the second position and the first shutter 22 is located at the opening position.

Referring to FIGS. 9A and 9B, the developer cartridge 20 may be provided with the moving member 210 installed to be slidable in the Z direction. The contact portion 112 may be fixed to the moving member 210 and may be connected with the circuit portion 111 by the signal line 113 (see FIG. 4). The knob 300 may be directly connected with the moving member 210. Thus, when the knob 300 is moved, the moving member 210 may be moved together with the knob 300.

The second connecting unit may connect the knob 300 and the moving member 210 and the first shutter 22. For example, the second connecting unit may be implemented by the first rack gear 211, the first and second pinions 201 and 202, and the second rack gear 22*d*. The first rack gear 211 may be provided for the moving member 210. The first pinion 201 may be rotatably connected to the developer cartridge 20 and may engage with the first rack gear 211. For example, the second pinion 202 may be installed coaxially with the first pinion 201 to rotate together with the first pinion 201. The second pinion 202 may engage with the second rack gear 22*d*.

By this configuration, when the knob 300 is moved, a linear operation of the knob 300 may be converted into a linear movement of the first shutter 22 by the first and second pinions 201 and 202 and the first and second rack gears 211 and 22*d* and thus the first shutter 22 may be switched to the closing position illustrated in FIG. 9A and the opening position illustrated in FIG. 9B. Simultaneously, the contact portion 112 may be moved to the first and second positions together with the moving member 210. Also, the protecting member 220 may be moved to the retracting position and the protruding position.

In the present embodiment, the first pinion 201 may have a different number of teeth than the second pinion 202 and thus the moving member 210 may have a different stroke than the first shutter 22. Although not illustrated, the second pinion 202 may engage with the first pinion 201 and the second rack gear 22*d*. In this case, one or more reduction gears may be interposed between the first pinion 201 and the second pinion 202. In some cases, an idle gear for determining the movement direction of the first shutter 22 may be interposed between the first pinion 201 and the second pinion 202. Also, although not illustrated, the second pinion 202 may be omitted and the first pinion 201 and the second rack gear 22*d* may be engaged with each other, so that the moving member 210 may have the same stroke as the first shutter 22.

Figure 10:
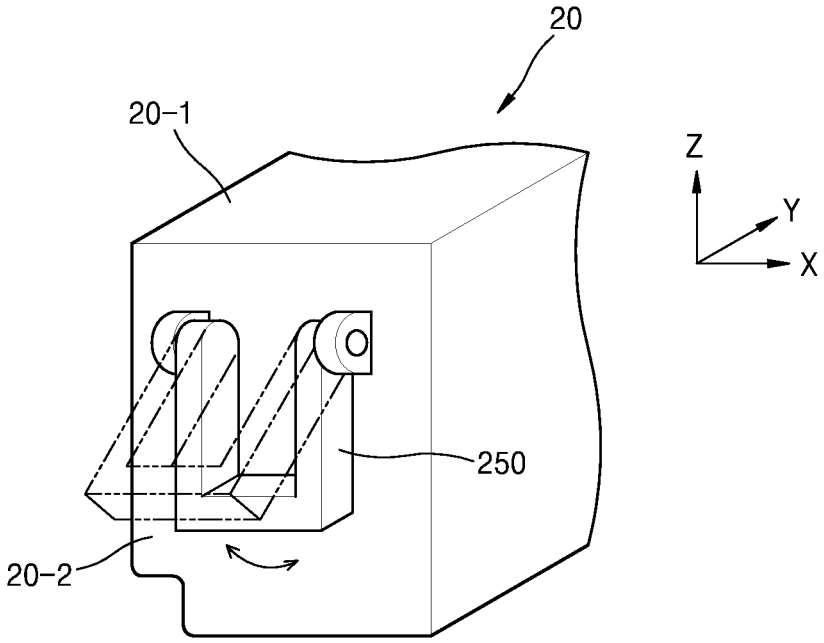
FIG. 10 is a partial perspective view of the developer cartridge, according to an embodiment.

FIG. 10 is a partial perspective view illustrating an embodiment of the developer cartridge 20. Referring to FIG. 10, the developer cartridge 20 may be provided with a handle 250 that is gripped by the user in the process of attaching/detaching the developer cartridge 20 to/from the main body 1. For example, the handle 250 may be provided at the side portion 20-2 in the attachment direction (Y). For example, the handle 250 may be located at a gripping position protruded from the side portion 20-2 of the developer cartridge 20 to grip the developer cartridge 20 as illustrated by a broken line in FIG. 10, and may be pivoted from the gripping position to a receiving position adjacent to the developer cartridge 20 as illustrated by a solid line in FIG. 10. The handle 250 may be located to face the door 2 so that the user may easily access the handle 250 in a state where the developer cartridge 20 is attached to the main body 1.

The operating portion may be implemented by the handle 250. That is, for example, the contact portion 112 and the first shutter 22 may be moved respectively to the first/second position and the closing/opening position in connection with the pivoting of the handle 250 to the gripping position and the receiving position.

Figure 11A:
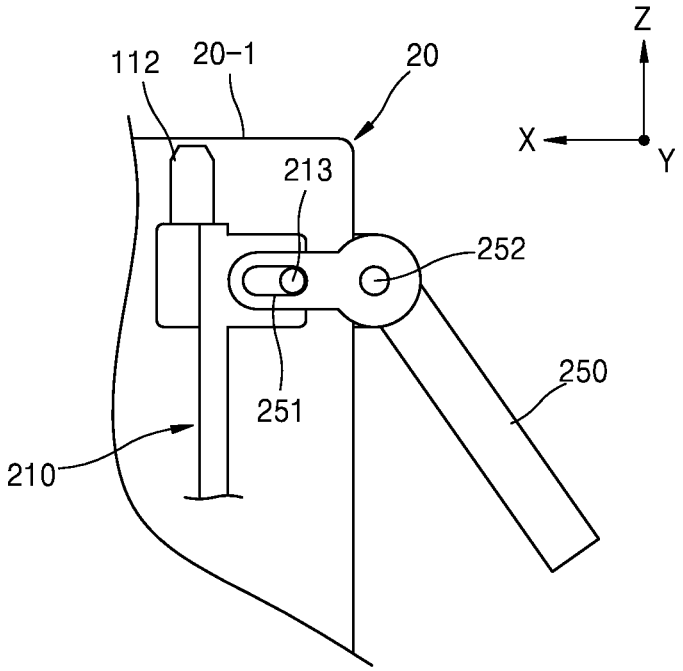
Figure 11B:
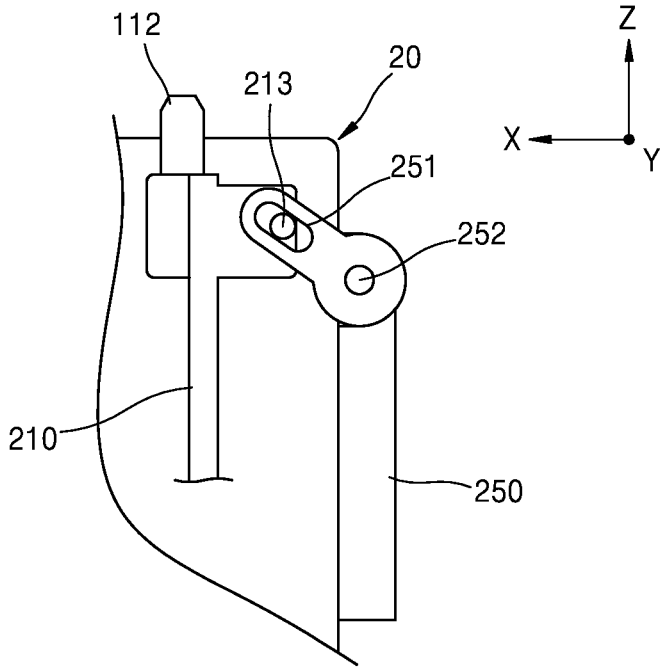

FIGS. 11A and 11B are schematic diagrams illustrating an embodiment of a structure for moving the contact portion 112 in connection with the handle 250. FIG. 11A is a side view in a state where the handle 250 is located at the gripping position, and FIG. 11B is a side view in a state where the handle 250 is located at the receiving position.

The moving member 210 may be installed at the developer cartridge 20 to be slidable in the vertical direction. The handle 250 may be connected with the moving member 210 by a first connecting unit. By the first connecting unit, a pivoting movement of the handle 250 may be converted into a sliding movement of the moving member 210. For example, the first connecting unit may be implemented by a pin-slot structure. The handle 250 may be provided with a guide slot 251. The moving member 210 may be provided with a guide pin 213. The guide pin 213 may be inserted into the guide slot 251. By this configuration, when the handle 250 is pivoted on a pivot shaft 252, the guide slot 251 may push the guide pin 213 and thus the moving member 210 may be slid in the vertical direction. Alternatively, the handle 250 may be provided with the guide pin 213, and the moving member 210 may be provided with the guide slot 251.

Although not illustrated, the first connecting unit may be implemented by a pinion-rack gear structure. For example, the first connecting unit may include one or more pinions rotated by the pivoting of the handle 250 and a rack gear provided at the moving member 210 to engage with the pinion.

A second connecting unit may connect the handle 250 and the moving member 210 and the first shutter 22. The second connecting unit may be implemented by a rack-pinion connection structure. For example, as illustrated in FIGS. 9A and 9B, the second connecting unit may include the first rack gear 211 provided for the moving member 210, the first and second pinions 201 and 202, and the second rack gear 22*d* provided for the first shutter 22. By this configuration, the first shutter 22 may be moved to the closing position and the opening position when the handle 250 is moved to the gripping position and the receiving position.

In order to attach the developer cartridge 20 to the main body 1, the developer cartridge 20 may be inserted into the main body 1 by holding the handle 250 located at the gripping position as illustrated in FIG. 11A. The handle 250 may be maintained at the gripping position since the movement of the contact portion 112 and the first shutter 22 to the second position and the opening position is restricted by the stopper 23 as described above. The contact portion 112 and the first shutter 22 may be located respectively at the first position and the closing position in a state where the handle 250 is located at the gripping position.

When the insertion is completed, as described above, the stopper 23 may be switched to the permitting position, and the movement of the contact portion 112 and the first shutter 22 to the second position and the opening position may be permitted. Thus, when the handle 250 is pushed, the handle 250 may be pivoted on the pivot shaft 252 and switched to the receiving position. Then, the moving member 210 may be slid by the operation of the guide pin 213 and the guide slot 251 and thus the contact portion 112 may be moved to the second position as illustrated in FIG. 11B. In this case, the first shutter 22 may be moved to the opening position by the connection structure of the first rack gear 211, the first and second pinions 201 and 202, and the second rack gear 22*d*.

In order to detach the developer cartridge 20 from the main body 1, the handle 250 may be pulled and pivoted to the gripping position. Then, the moving member 210 may be slid by the operation of the guide pin 213 and the guide slot 251 to return the contact portion 112 to the first position as illustrated in FIG. 11A, and the first shutter 22 may be returned to the closing position by the connection structure of the first rack gear 211, the first and second pinions 201 and 202, and the second rack gear 22*d*. In this state, the handle 250 may be held to pull and detach the developer cartridge 20 from the main body 1. The stopper 23 may be returned to the restricting position in the detachment process, and the contact portion 112 and the first shutter 22 may be maintained respectively at the first position and the closing position by the stopper 23 when the developer cartridge 20 is detached from the main body 1.

Figure 12:
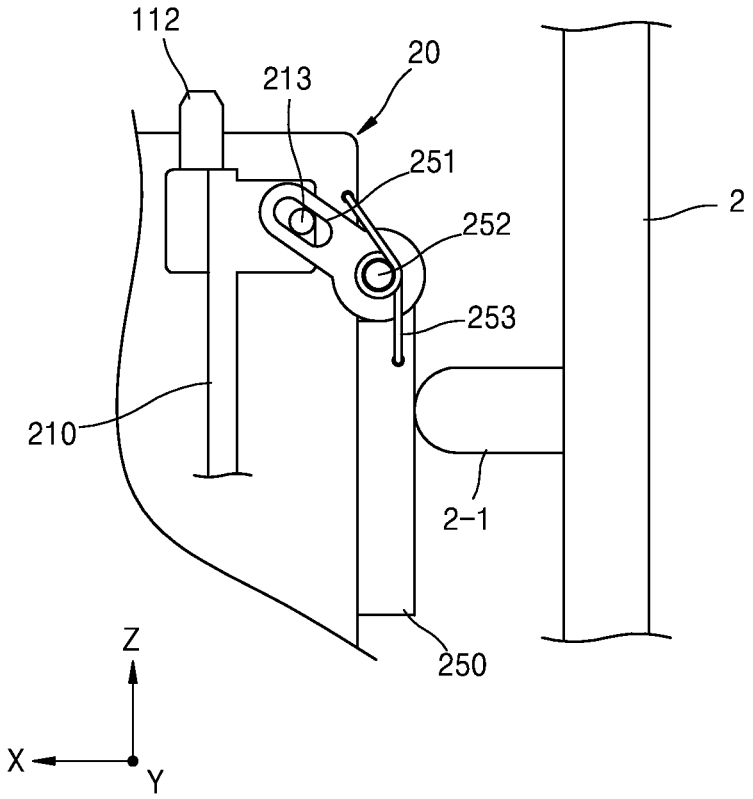
FIG. 12 is a schematic diagram illustrating a structure for moving the handle to the receiving position by a closing operation of a door, according to an embodiment.

The handle 250 may be moved from the gripping position to the receiving position by a closing operation of the door 2. FIG. 12 is a schematic diagram illustrating an embodiment of a structure for moving the handle 250 to the receiving position by a closing operation of the door 2. Referring to FIG. 12, the door 2 may be provided with an arm 2-1 for pushing the handle 250 to the receiving position when it is closed. By this configuration, after the developer cartridge 20 is attached to the main body 1, the handle 250 may be pivoted to the receiving position by the closing operation of the door 2, and the contact portion 112 and the first shutter 22 may be switched respectively to the second position and the opening position. Accordingly, a connection error between the contact portion 112 and the connecting portion 1*a* may be prevented. Also, since the first shutter 22 is switched to the opening position, it may be possible to prevent an error of starting an image formation in a state where the first shutter 22 is located at the closing position.

As illustrated in FIG. 12, the developer cartridge 20 may further include an elastic member 253 for supplying the handle 250 with an elastic force in the direction of pivoting to the gripping position. By this configuration, when the door 2 is opened, the handle 250 may be pivoted by the elastic force of the elastic member 253 to the gripping position illustrated in FIG. 11A, and the contact portion 112 and the first shutter 22 may be returned respectively to the first position and the closing position. Accordingly, the user's convenience may be improved.

Although the inventive concept has been described with reference to the embodiments illustrated in the drawings, this is merely an example and those of ordinary skill in the art will understand that various modifications and other equivalent embodiments may be possible therefrom. Thus, the true technical scope of the inventive concept should be defined by the following claims.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A developer cartridge attachable to and detachable from a main body of an image forming apparatus and configured to accommodate a developer therein, the developer cartridge comprising:

a memory unit comprising a contact portion movable to a first position at which the contact portion is hidden inside the developer cartridge and to a second position at which the contact portion is protruding outside the developer cartridge;

an operating portion configured to move the contact portion to the first position and the second position;

an outlet configured to discharge the developer from the developer cartridge; and a first shutter having an opening position and a closing position for opening and closing the outlet, respectively, the first shutter moving to the closing position and the opening position when the contact portion is moved by the operating portion to the first position and the second position, respectively.

2. The developer cartridge of claim 1, further comprising a moving member on which the contact portion is mounted, the contact portion and the moving member moving with each other when the contact portion moves to the first position and the second position.

3. The developer cartridge of claim 2, wherein the operating portion comprises a rotary knob.

4. The developer cartridge of claim 3, wherein:

the rotary knob is connected with the moving member to impart movement to the moving member when the rotary knob is operated; and the rotary knob is connected with the first shutter to impart movement to the first shutter when the rotary knob is operated.

5. The developer cartridge of claim 2, wherein the operating portion comprises a sliding knob.

6. The developer cartridge of claim 5, wherein the sliding knob is connected with the moving member to impart movement to the moving member when the sliding knob is operated; and the moving member is connected to the first shutter to impart movement to the first shutter when the moving member moves.

7. The developer cartridge of claim 2, wherein the operating portion comprises a handle having a receiving position and a gripping position for gripping the developer cartridge.

8. The developer cartridge of claim 7, wherein the contact portion and the first shutter are located respectively at the first position and the closing position when the handle is at the gripping position; and the contact portion and the first shutter are switched respectively to the second position and the opening position when the handle is switched from the gripping position to the receiving position.

9. The developer cartridge of claim 1, further comprising a stopper located at a restricting position for restricting an operation of the operating portion when the developer cartridge is detached from the main body.

10. The developer cartridge of claim 9, wherein the stopper is switched to a permitting position for permitting the first shutter to move to the opening position, when the developer cartridge is attached to the main body.

11. The developer cartridge of claim 10, wherein when the stopper at the restricting position, the stopper and a locking portion of the first shutter are locked by each other such that the first shutter is restricted from switching to the opening position.

12. An electrophotographic image forming apparatus comprising:

a main body; and the developer cartridge of claim 1 attachable to and detachable from the main body.

13. A developer cartridge attachable to and detachable from a main body of an image forming apparatus, the developer cartridge comprising:

a memory unit comprising a contact portion movable to a first position at which the contact portion is hidden inside the developer cartridge and to a second position at which the contact portion is protruding outside the developer cartridge;

an operating portion configured to move the contact portion to the first position and the second position; and a stopper, located at a restricting position for restricting an operation of the operating portion when the developer cartridge is detached from the main body.

14. The developer cartridge of claim 13, wherein the stopper is switched to a permitting position for permitting the operation of the operating portion, when the developer cartridge is attached to the main body.

15. The developer cartridge of claim 14, further comprising:

a moving member on which the contact portion is mounted, the contact portion and the moving member moving with each other when the contact portion moves to the first position and the second position;

an outlet configured to discharge a developer accommodated in the developer cartridge; and a first shutter having an opening position and a closing position for opening and closing the outlet, the moving member and the first shutter connected such that the first shutter is moved to the closing position and the opening position when the moving member is moved to the first position and the second position, respectively.

16. The developer cartridge of claim 15, wherein when the stopper is at the restricting position, the stopper and the locking portion are locked by each other such that the first shutter is restricted from switching to the opening position.

17. An electrophotographic image forming apparatus comprising:

a main body; and a developer cartridge attachable to and detachable from the main body and configured to accommodate a developer therein, the developer cartridge comprising:

a pivot shaft disposed on and along a side of the developer cartridge, a handle configured to pivot on the pivot shaft and having a receiving position, at which the handle is adjacent to the side of the developer cartridge, and a gripping position, at which the handle is pivoted away from the side of the developer cartridge, for gripping the developer cartridge, an outlet configured to discharge the developer from the developer cartridge, a first shutter connected with the handle such that the first shutter switches to a closing position for closing the outlet and to an opening position for opening the outlet when the handle is switched to the gripping position and the receiving position, respectively, and a stopper configured to maintain the first shutter at the closing position when the developer cartridge is detached from the main body.

18. The electrophotographic image forming apparatus of claim 17, further comprising a developing device configured to receive a developer from the developer cartridge, wherein the stopper interferes with the developing device to be switched to a permitting position for permitting the first shutter to be switched to the opening position when the developer cartridge is attached to the main body.

19. The electrophotographic image forming apparatus of claim 17, further comprising a door configured to open and close a portion of the main body, wherein the handle is switched to the receiving position by a closing operation of the door after the developer cartridge is attached to the main body.

20. An electrophotographic image forming apparatus comprising:

a main body;

a developer cartridge attachable to and detachable from the main body and configured to accommodate a developer therein, the developer cartridge comprising:

a handle having a receiving position and a gripping position for gripping the developer cartridge, an outlet configured to discharge the developer from the developer cartridge, a first shutter connected with the handle such that the first shutter switches to a closing position for closing the outlet and to an opening position for opening the outlet when the handle is switched to the gripping position and the receiving position, respectively, and a stopper configured to maintain the first shutter at the closing position when the developer cartridge is detached from the main body; and a memory unit comprising a contact portion connected with the handle such that the contact portion moves to a first position at which the contact portion is hidden inside the developer cartridge and to a second position at which the contact portion is protruding outside the developer cartridge when the handle is switched to the gripping position and the receiving position, respectively.

* * * * *